United States Patent [19]

Urakawa et al.

[11] Patent Number: 5,049,806

[45] Date of Patent: Sep. 17, 1991

[54] BAND-GAP TYPE VOLTAGE GENERATING CIRCUIT FOR AN ECL CIRCUIT

[75] Inventors: Yukihiro Urakawa, Kawasaki; Masataka Matsui, Tokyo, both of Japan

[73] Assignee: Kabushiki Kaisha Toshiba, Kawasaki, Japan

[21] Appl. No.: 456,556

[22] Filed: Dec. 26, 1989

[30] Foreign Application Priority Data

Dec. 28, 1988 [JP] Japan ..... 63-333608

[51] Int. Cl.[5] ..... G05F 3/30

[52] U.S. Cl. ..... 323/314; 307/296.6; 307/296.7; 323/317; 323/907

[58] Field of Search ..... 323/313, 314, 317, 907; 307/296.6, 296.7, 446, 445; 330/261

[56] References Cited

U.S. PATENT DOCUMENTS

| | | | |
|---|---|---|---|
| 3,893,018 | 7/1975 | Marley | 323/313 |
| 4,100,477 | 7/1978 | Tam . | |
| 4,100,478 | 7/1978 | Tam | 323/314 |
| 4,176,308 | 11/1979 | Dobkin et al. . | |
| 4,277,739 | 7/1981 | Priel | 323/313 |
| 4,628,248 | 12/1986 | Birrittella et al. | 323/314 |
| 4,644,249 | 2/1987 | Chang | 323/313 |
| 4,725,770 | 2/1988 | Okutsu et al. . | |
| 4,810,902 | 3/1989 | Storti et al. | 323/317 |
| 4,849,933 | 7/1989 | Allen | 307/466 |

FOREIGN PATENT DOCUMENTS

| | | |
|---|---|---|
| 0288939A1 | 11/1988 | European Pat. Off. . |
| 59-224923 | 12/1984 | Japan . |
| WO85/02472 | 6/1985 | PCT Int'l Appl. . |

OTHER PUBLICATIONS

"Bipolar and MOS Analog Integrated Circuit Design", Grebene, Alan B., John Wiley & Sons, 1984, pp. 206–209.

*Primary Examiner*—William H. Beha, Jr.
*Attorney, Agent, or Firm*—Banner, Birch, McKie & Beckett

[57] ABSTRACT

A voltage generating circuit includes a first current source which generates a first current and a first voltage generating circuit which generates a first voltage having a first temperature dependency. A second voltage generating circuit generates a second voltage having a second temperature dependency different than the first temperature dependency. A voltage adder circuit coupled to the first and second voltage generating circuits adds the first and second voltages to generate a third voltage having no temperature dependency. A voltage replicating circuit coupled to the voltage adder circuit coupled to the voltage adder circuit replicates the third voltage as a fourth voltage having a level corresponding to the third voltage. A second current source generates a constant second current through a resistive element biased by the fourth voltage and a current replicating circuit coupled to the first and second current sources replicates the second current as the first current.

10 Claims, 8 Drawing Sheets

BAND-GAP TYPE VOLTAGE GENERATING CIRCUIT FOR AN ECL CIRCUIT

BACKGROUND OF THE INVENTION

1. Field of the Invention

The present invention relates to a voltage generating circuit using a band gap type of constant voltage source formed in a Bi-CMOS semiconductor integrated circuit in which bipolar devices and complementary insulated gate devices are fabricated in the same substrate and, more particularly, to a voltage generating circuit for generating a reference potential for use with an emitter-coupled logic circuit (hereinafter abbreviated to an ECL circuit).

2. Description of the Related Art

FIG. 1 illustrates an example of an ECL circuit in which Q1 and Q2 designate a differential pair of NPN transistors having their bases respectively connected to receive a signal voltage Vin and a reference voltage VBB and their emitters connected together, Q3 a constant-current source NPN transistor having its collector connected to the emitters of transistors Q1 and Q2 and its base supplied with a reference voltage VCS, R1 and R2 resistors connected between $V_{CC}$ power supply and collectors of transistors Q1 and Q2, and R3 a resistor connected between the emitter of transistor Q3 and VEE power supply.

The above ECL circuit needs two types of reference potentials $V_{BB}$ and $V_{CS}$, $V_{BB}$ being applied to the base of transistor Q2 as a threshold voltage which lies midway between a "1" logic level and a "0" logic level of ECL logic and Vcs being applied to the base of transistor Q3. The logical amplitude in ECL logic is low as about 0.8 volts and the allowable range of variability of reference potentials $V_{BB}$ and Vcs is small. Thus, a reference potential generating circuit is required which is small in the temperature dependence and power supply voltage dependence.

Heretofore, a band gap constant voltage circuit such as that as shown in FIG. 2 has been used as a voltage generating circuit for generating such reference potentials. As is well known, the constant voltage circuit uses such a Widlar circuit as shown in FIG. 3, in which Q1 to Q6 denote NPN transistors, R1 to R3 and R11 to R33 resistors, Vcc and $V_{EE}$ power supplies, Vcs and $V_{BB}$ reference potential outputs and A to C nodes.

Next, the principle of operation of the band gap constant voltage circuit and the Widlar circuit will be described with reference to FIGS. 4A, 4B and 5. In general, the base-to-emitter voltage $V_{BE}$ of a bipolar transistor has such temperature dependence as shown in FIG. 4A, the sign of which is negative. The thermal voltage VT of a semiconductor device is represented by k T/q (k=Boltzmann constant, T=absolute temperature and q=electronic charge) and has the temperature dependence the sign of which is positive as shown in FIG. 4B. In FIG. 5 which illustrates the principle of operation of the voltage generating circuit of FIG. 2, generation of k VT by VT generating circuit 91 and multiply-by-K circuit 92 and addition by adder circuit 94 of $V_{BE}$ from $V_{BE}$ generating circuit 93 and K VT will meet the following temperature compensation condition:

$$(dV_{BE}/dT)+K\,dVT/dT)=0 \quad (1)$$

The output potential Vout will be a constant potential with no temperature dependence which is given by $$Vout=V_{BE}+K\,VT \quad (2)$$

In the Widlar circuit of FIG. 3, assuming that currents flowing through transistors Q1, Q2 and Q3 are I1, I2 and I3, respectively, diode saturation currents of transistors Q1 and Q2 are Is1 and Is2, respectively, and base currents of transistors are small enough to be neglected, then a voltage V1 across resistor R1 will be given by $$V1=VT\,nI1\,/\,Is1$$

$$V1=I2R3+(VT\,n\,I2\,/\,Is2)$$

A voltage V2 across resistor R2 will be given by $$V2 = I2\,R2 = [(R2/R3)\ln\{(Is2/Is1)\,(I1/I2)\}]VT = K\,VT \quad (3)$$

Adder circuit 94 for adding $V_{BE}$ and K VT shown in FIG. 5 can be implemented by connecting to the base of transistor Q3 a low-potential end of resistor R2 across which voltage V2 is developed. A potential difference between the high-potential end of resistor R2 and the emitter of transistor Q3 is given by expression (2). The condition of expression (1) can be met by adjusting the emitter area ratio (Is1/Is2) of transistors Q1 and Q2, current ratio (I1/I2) and resistance ratio (R2/R3) in expression (3).

In the band gap constant voltage circuit shown in FIG. 2, resistor R33 serves as a bias resistor for transistors Q4 and Q5 as well as a current source of current I3. Also, transistors Q4 and Q5 serve as current sources of currents I1 and I2. Potential difference Vcs between node B and $V_{EE}$ potential point has no temperature dependence. If resistors R22 and R2 have the same resistance, then the same voltage as voltage V2 across resistor R2 will be developed across resistor R22. If currents I1 and I3 flowing through transistors Q6 and Q3 are adjusted to keep the same emitter current density, then the same base-to-emitter voltages $V_{BE}$ will be developed, which have the same temperature dependence. Thus, the potential difference $V_{BB}$ between $V_{CC}$ potential point and node A will have no temperature dependence as with the base-to-emitter voltage of transistor Q3.

However, a voltage across the resistance R3 varies to a greater extent than a power supply voltage so that the dependency of the current I3 upon the power supply voltage is greater. The base-to-emitter voltage $V_{BE}$ of the transistor Q3 increases with an increasing current and an output potential Vout also has a power supply voltage dependency.

Thus, as the current I3 reveals such a power supply voltage dependency, so the base-to-emitter voltage $V_{BE}$ of the transistor Q3 also reveals the power supply voltage dependency. As appreciated from the expression (3), the output voltage Vout has the power supply voltage dependency.

Further, the temperature coefficient d $V_{BE}$/dT of the base-to-emitter voltage $V_{BE}$ of the bipolar transistor varies due to a collector current (when the collector current increases, the absolute value of the temperature coefficient $V_{BE}$/dT decreases). For this reason, the temperature requirement as represented by the expression (1) varies due to a variation of electric current $I_3$ caused by a variation of the power supply voltage. Thus the output voltage Vout is not temperature-compensated over a broader power source voltage range and has a temperature dependency.

That is, problems arise with the prior art band gap constant voltage circuit shown in FIG. 2 in that, as shown in FIGS. 6A and 6B, current I3 increases with increasing power supply voltage (voltage between $V_{CC}$ potential and $V_{EE}$ potential), currents I1 and I2 increase with an increase in the potential at node C, the temperature compensation condition represented by expression (1) becomes unsatisfied, and voltage $V_{BB}$ between node A and Vcc potential and voltage Vcs between node B and $V_{EE}$ potential increase.

To eliminate the above problems, such a band-gap type voltage regulator circuit as shown in FIG. 7 has been used. In FIG. 7, a resistor Rc is connected between the collector of transistor Q3 and resistor R33 and a PNP transistor Qc has its collector connected to $V_{EE}$ and its base emitter path connected across resistor Rc so as to clamp the voltage across resistor Rc to hold current I3 constant. According to such a band-gap voltage regulator, the temperature compensation condition is satisfied over a wide range of the supply voltage so that output voltage Vout will have no temperature dependence.

A problem arises, however, in the case where PNP transistor Qc is fabricated in a bipolar integrated circuit along with NPN transistors Q1 to Q6 in that additional manufacturing steps are required. This will increase manufacturing cost and decrease yield.

As described above, the problems with the prior art voltage regulator are an increase in manufacturing steps, an increase in cost and a decrease in yield which result from the use of a PNP transistor for satisfying the temperature compensation condition over a wide range of the power supply voltage to produce an output voltage with no temperature dependence.

SUMMARY OF THE INVENTION

It is an object of the present invention to provide a voltage generating circuit which can be implemented only by using existing NPN transistors, MOS transistors and resistors in a Bi-CMOS integrated circuit without an increase of manufacturing steps, and satisfies the temperature compensation condition over a wide range of power supply voltage to supply a constant output voltage with no temperature dependence.

According to the present invention, there is provided a voltage generating circuit comprising:

a voltage generating circuit for generating a first voltage proportional to a temperature voltage;

a bipolar transistor having its collector-to-emitter path connected between a first current source and a second potential;

a voltage adder circuit for adding the first voltage and base-to-emitter voltage of the bipolar transistor and generating a second voltage;

a voltage replicating circuit for replicating the second voltage as a third voltage of a corresponding level;

a second current source for generating a constant current through a resistive impedance element which is biased by the third voltage; and a current replicating circuit for replicating the second current source as the first current source.

According to the present invention, the voltage adder circuit adds a first voltage having a positive temperature dependency proportional to a temperature voltage generated from the voltage generating circuit and a base-to-emitter voltage having a negative temperature dependency of the bipolar transistor using a current from the first current source as a collector current and produces a second voltage (output voltage) free from temperature dependency.

The voltage replicating circuit replicates the output voltage as a third voltage of a level equal to that of the output voltage and applies the third potential to the second current source composed of the resistive impedance element.

The current replicating circuit replicates a current coming from the second current source as a current of the first current source.

That is, a feedback circuit is provided for restricting the first current source by the output voltage produced from the voltage adder circuit.

According to the present invention, therefore, once the circuit constant (the dimension of the respective element) of elements constituting the circuit is determined, not only the output voltage but also the current value of the first current source is unconditionally determined and, at the same time, the factor depending upon the power supply voltage can be eliminated. It is, therefore, possible to eliminate the dependency of the output voltage upon the power supply voltage and the consequent temperature dependency.

DETAILED DESCRIPTION OF THE PREFERRED EMBODIMENTS

Figure 8:
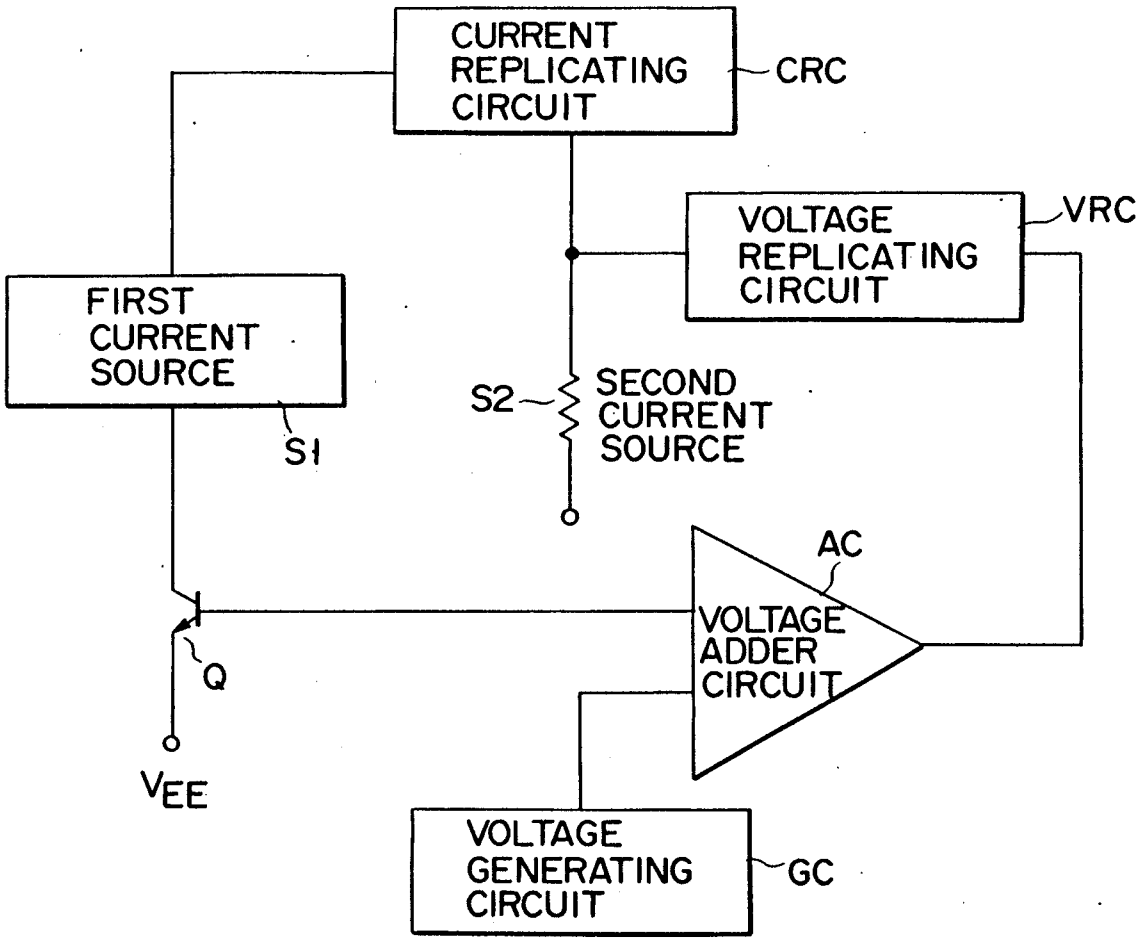
FIG. 8 is a circuit diagram showing a basic circuit in a voltage generating circuit of the present invention.

FIG. 8 is a basic circuit of a voltage generating circuit according to the present invention.

In FIG. 8, a voltage adder circuit AC adds a first voltage having a positive temperature dependency proportional to a temperature voltage generated from a voltage generating circuit GC and a base-to-emitter voltage having a negative temperature dependency of a bipolar transistor Q using a current coming from a first current source $S_1$ as a collector current, and generates a second voltage (output voltage) free from temperature dependency.

A voltage replicating circuit $V_{RC}$ replicates the output voltage as a third voltage of a level equal to that of the output potential and applies the third voltage to a second current source S2 constituting a resistive impedance element.

A current replicating circuit $C_{RC}$ replicates a current coming from a second $S_2$ as a current for the first current source $S_1$. That is, a feedback circuit is provided for restricting the first current source $S_1$ by the output voltage delivered from the voltage adder circuit AC.

Thus, according to the present invention, once the circuit constant (the dimension of the respective constituent elements) of the elements constituting the circuit is determined, not only the output voltage but also the current value of the first current source $S_1$ is unconditionally determined and it is also possible to eliminate a factor depending upon the power source voltage. It is thus possible to eliminate the dependency of the output voltage upon the power supply voltage and the consequent temperature dependency.

Figure 9:
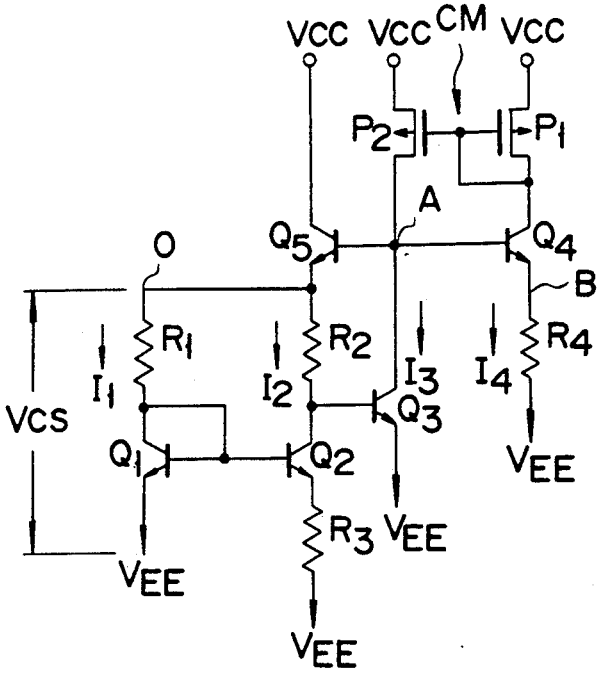
FIG. 9 is a circuit diagram of a voltage generating circuit according to an embodiment of the present invention.

FIG. 9 illustrates a voltage generating circuit formed in a Bi-CMOS integrated circuit adaptable for low power dissipation and high density integration. The voltage generating circuit uses a band gap type of voltage regulating circuit. More specifically, a first NPN transistor Q1 has its collector and base connected together and its emitter connected to $V_{EE}$ potential source. A first resistor R1 is connected between the collector of transistor Q1 and a first constant current source. A second NPN transistor Q2 has its base connected to the base and collector of transistor Q1. A second resistor R2 is connected between the collector of transistor Q2 and a second constant current source and a third resistor R3 is connected between the emitter of transistor Q2 and $V_{EE}$ potential. A third NPN transistor Q3 has its base connected to the collector of transistor Q2 and its collector-emitter path connected between a third constant current source and $V_{EE}$ potential source.

The above third constant current source is formed as described below. That is, the base of a fourth NPN transistor Q4 is connected to the collector of transistor Q3 and a fourth resistor R4 is connected between the emitter of transistor Q4 and $V_{EE}$ potential. Between Vcc potential and the collector of transistor Q4 is connected the source-drain path of a first P channel MOS transistor Pl having its gate and drain connected together. To the gate and drain of transistor Pl is connected the gate of a second P channel MOS transistor P2 having its source connected to Vcc potential and its drain connected to the collector of transistor Q3. Transistors Pl and P2 forms a P channel current mirror circuit CM.

The first and second constant current sources are formed of a fifth NPN transistor Q5 having its base connected to the collector of third NPN transistor Q3, its emitter connected in common to first and second resistors R1 and R2 and its collector connected to the Vcc potential.

The operation of the above voltage generating circuit will be described next. The base of fourth NPN transistor Q4 is connected to the collector of third NPN transistor Q3 and resistor R4 is connected between the emitter of Q4 and $V_{EE}$ potential so that transistor Q4 and resistor R4 form a constant current source producing constant current I4. The constant current I4 flows between the drain and gate of P channel transistor P2 on the reference side of P-channel current mirror CM so that the gate of P-channel transistor P2 is supplied with a predetermined bias potential. Where P-channel transistor P2 operates in the pentode region, its source-drain current is constant so that constant current I3 flows from P-channel transistor P2 into third NPN transistor Q3. In this case, if the emitter areas of transistors Q5 and Q4 are adjusted to adjust currents I1 +I2 and I4 so that transistors Q5 and Q4 may have the same emitter current density, then the same base to-emitter voltage $V_{BE}$ will be produced in transistors Q4 and Q5 with the result that the potential of the emitter (node O) of transistor Q5 and the potential of the emitter (node B) of transistor Q4 become equal to each other. At the node A, the voltage of the transistor Q5 rises by its base-to-emitter voltage relative to its emitter voltage. At the node B, the voltage of the transistor Q4 falls by its base-to-emitter voltage relative to the node A. As a result, the transistors Q4 and Q5 become the same potential level. That is, the emitter voltage of the transistor Q5 is replicated as the emitter voltage of the transistor Q4. If the potential at node O has no temperature dependence and supply voltage dependence, the node B will exhibit the same property. A constant voltage is always developed across resistor R4, thus producing constant current I4 with no temperature dependence and supply voltage dependence. The constant current I4 is folded back to constant current I3 in current mirror CM. Assuming P-channel transistors P1 and P2 to be W1 and W2 in channel width and equal to each other in channel length, then $$I3=(W2 / W1)\ I4 \tag{4}$$

Figure 12:
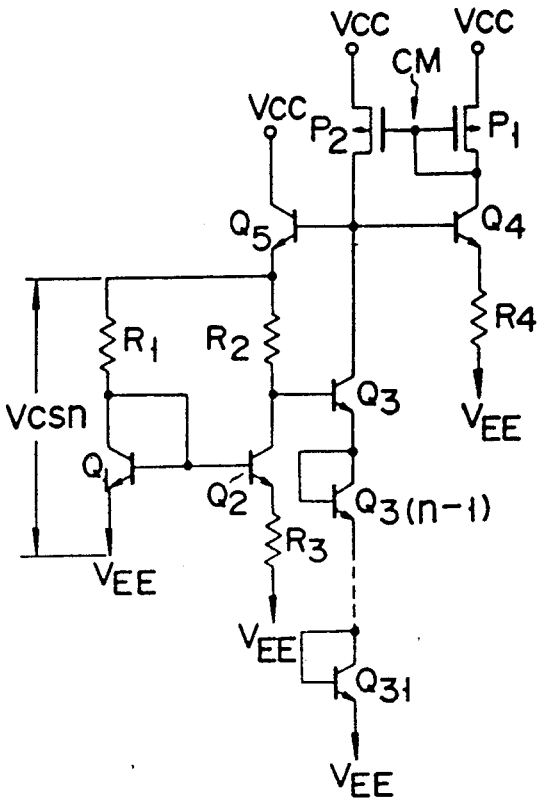
FIG. 12 is a circuit diagram of a voltage generating circuit according to still another embodiment of the present invention.
Figure 1:
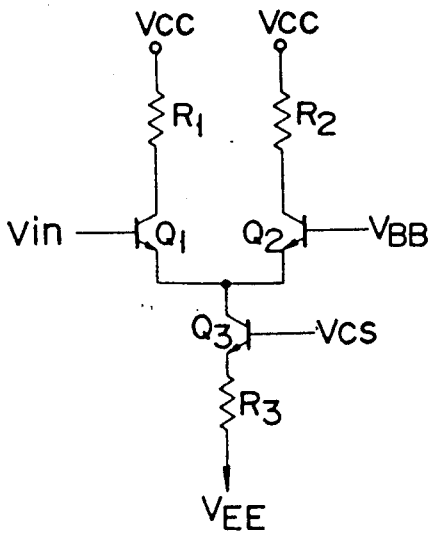
F I G. 1 (PRIOR ART)
FIG. 1 illustrates an example of an emitter coupled logic circuit.
Figure 10:
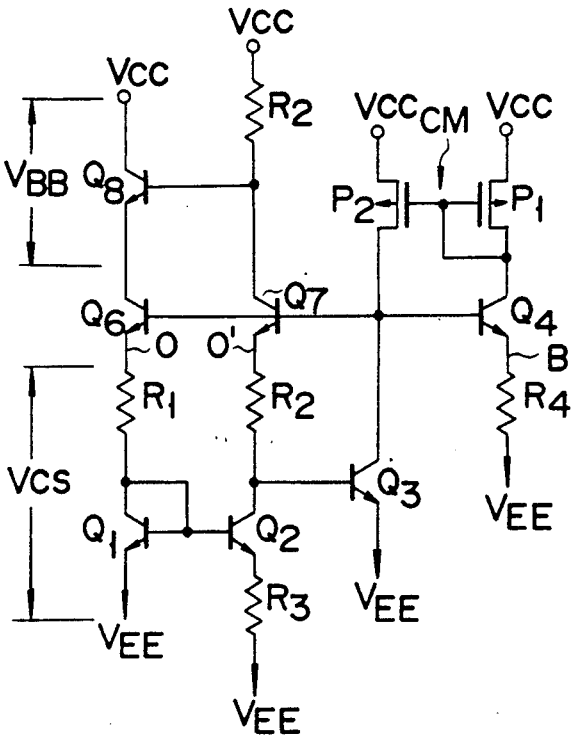
FIG. 10 is a circuit diagram of a voltage generating circuit according to another embodiment of the present invention.

The constant current I3 can thus take any given value. However, expression (4) contains no short channel effect and narrow channel effect. To obtain constant current I3 approximating to expression (4), it is required to make the channel width and channel length sufficiently large. Constant current I3 is produced by the use of P-channel current mirror CM and is thus not influenced at all by the temperature characteristics of MOS transistors. A sufficiently large channel length will have little short channel effect and almost have no supply voltage dependence. In addition, constant current I3 almost never changes even if the base-to-emitter voltages $V_{BE}$ of transistors Q5 and Q4 vary with temperature so that the potential of the collector (node A) of transistor Q3 varies, because P-channel transistor P2 always operates in the pentode region. If, therefore, the channel width and channel length are made sufficiently large, a desired constant current I3 will be supplied to transistor Q3. Hence, the output potential Vcs from node O is significantly improved in the supply voltage dependence and temperature dependence, thus permitting the supply of a constant output potential over a wide range of supply voltage. The voltage generating circuit of the present invention may be modified as shown in FIG. 10 or FIG. 12. The voltage generating circuit of FIG. 10 differs from the voltage generating circuit of FIG. 9 only in arrangements of first and second constant current sources. In FIG. 10, therefore, like reference numerals are used to designate corresponding parts to those in FIG. 9. The first constant current source is comprised of a sixth NPN transistor Q6 having its base connected to the collector of transistor Q3 and its emitter connected to resistor Rl. The second constant current source is comprised of a seventh NPN transistor Q7 having its base connected to the collector of transistor Q3 and its emitter connected to resistor R2. A resistor R2 is connected between the collector of transistor Q7 and VCC potential. To the collector of transistor Q7 is connected the base of an eighth NPN transistor Q8 having its collector and emitter connected to $V_{CC}$ potential and resistor R1, respectively.

Figure 11A:
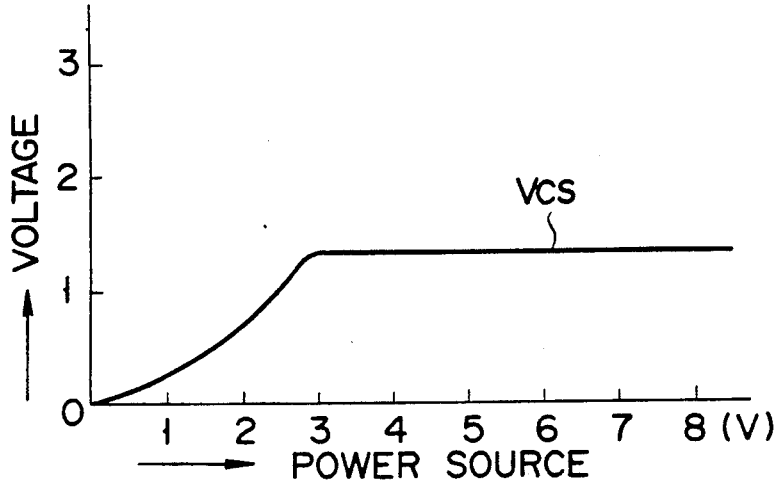
FIG. 11A is a graph illustrating the Vcc power supply voltage dependence of the output potential of the voltage generating circuit of FIG. 9.
Figure 11B:
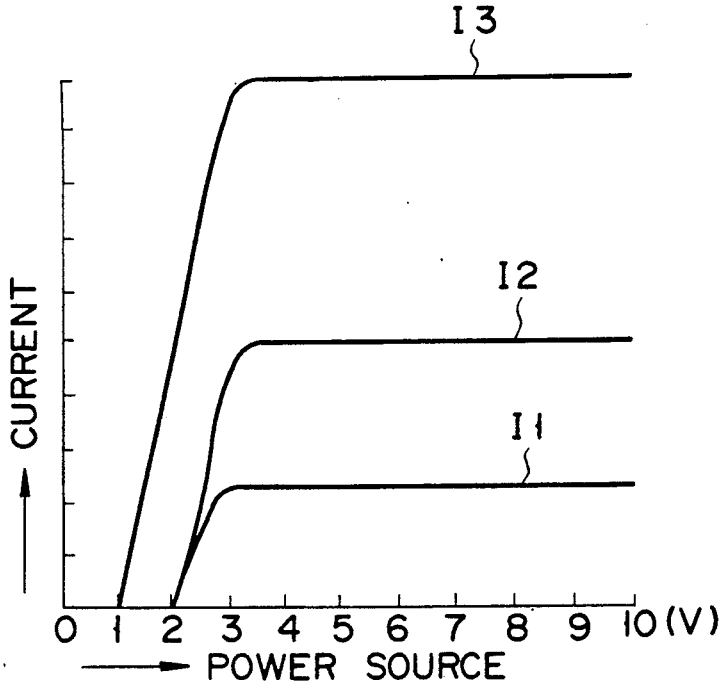
FIG. 11B is a graph illustrating the Vcc power supply voltage dependence of the constant current of the voltage generating circuit of FIG. 9.

The operation of the voltage generating circuit of FIG. 10 is basically the same as that of the voltage generating circuit of FIG. 9. Constant current I4 is produced by fourth NPN transistor Q4 and P-channel current mirror CM is responsive to current I4 to produce constant current I3. With the voltage generating circuit, if the emitter areas of transistors Q6, Q7 and Q4 are adjusted to adjust currents I1, I2 and I3 for the same emitter current density, then transistors Q6, Q7 and Q4 will produce base-to-emitter voltages VBE of equal magnitude. Consequently the emitter (node O) of transistor Q6, the emitter (node Oa) of transistor Q7 and the emitter (node B) of transistor Q4 are placed at the same potential to output potential Vcs from node O and potential $V_{BB}$ from the collector of transistor Q6. In this case, as shown in FIGS. 11A and 11B, constant currents I1, I2 and I3 exhibit almost no supply voltage dependence. If the dimensions of devices are set to satisfy the temperature compensation condition of expression (1) at a given supply voltage, constant output potentials Vcs and $V_{BB}$ will be provided which have no temperature dependence over a wide range of Vcc supply voltage.

The voltage generating circuit shown in FIG. 12 differs from the voltage generating circuit of FIG. 9 only in that a plurality of NPN transistors Q31 to Q3(n−1) each having its collector and base connected together are connected in series between the emitter of third NPN transistor Q3 and $V_{EE}$ potential. Like reference numerals are used to designate corresponding parts to those of FIG. 9.

In the case of the voltage generating circuit of FIG. 11, the temperature compensation condition is given by $$n\,(dV_{BE}/dT)+(Kn\,dVT/dT)=0 \quad (5)$$

An output potential Vcsn will be $$Vcsn=n\,V_{BE}+Kn\,VT \quad (6)$$

Figure 2:
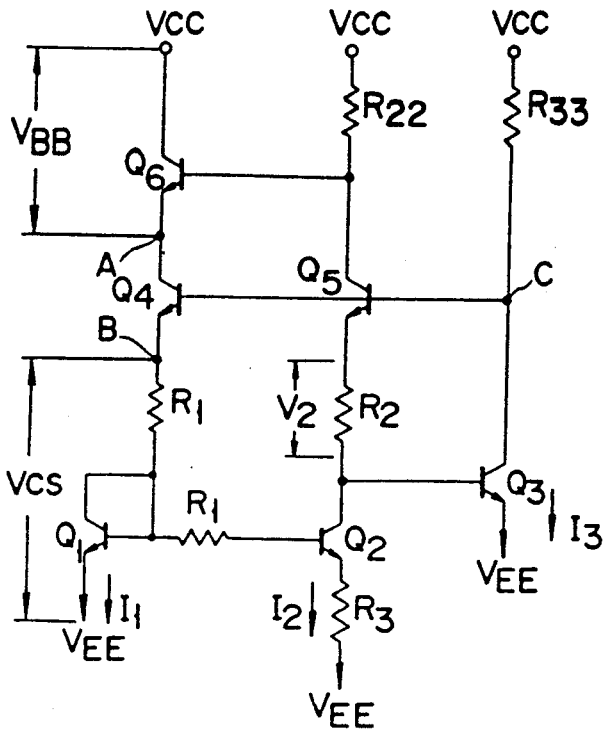
FIG. 2 (PRIOR ART)
FIG. 2 is a circuit diagram of a prior art voltage generating circuit.
Figure 3:
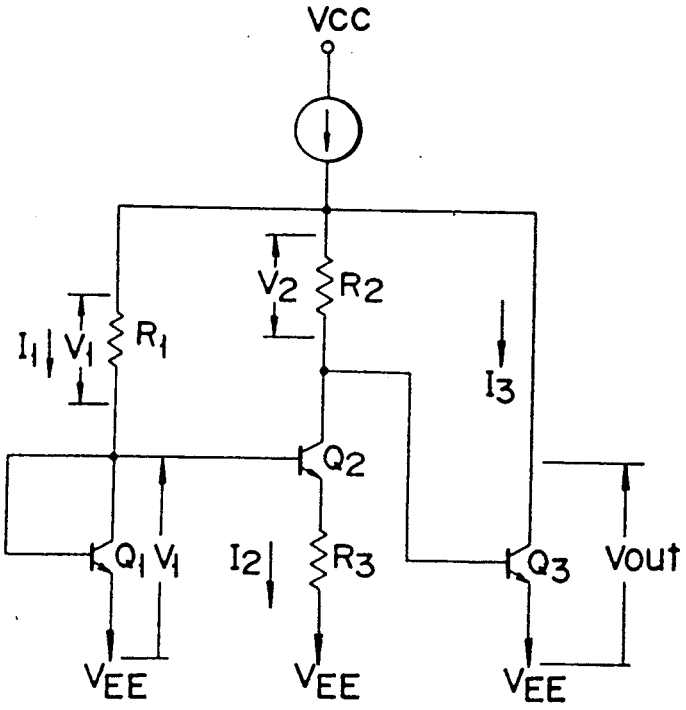
FIG. 3 (PRIOR ART)
FIG. 3 illustrates the Widlar circuit used in the prior art voltage generating circuit of FIG. 2.
Figure 4A:
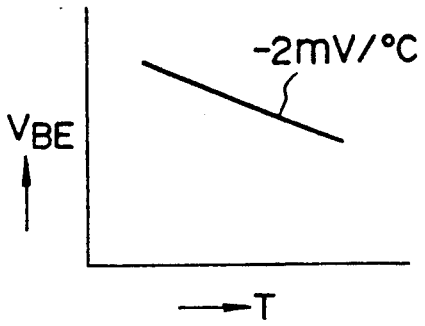
FIG. 4A (PRIOR ART)
FIG. 4A is a graph illustrating the temperature dependence of the base-emitter voltage of a bipolar transistor.
Figure 4B:
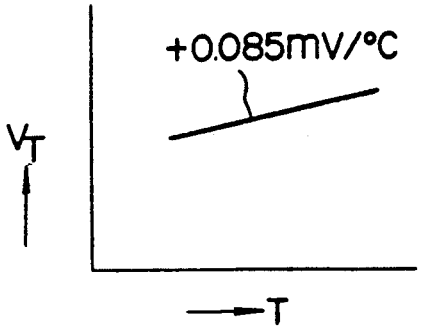
FIG. 4B (PRIOR ART)
FIG. 4B is a graph illustrating the temperature dependence of the thermal voltage of a bipolar transistor.
Figure 5:
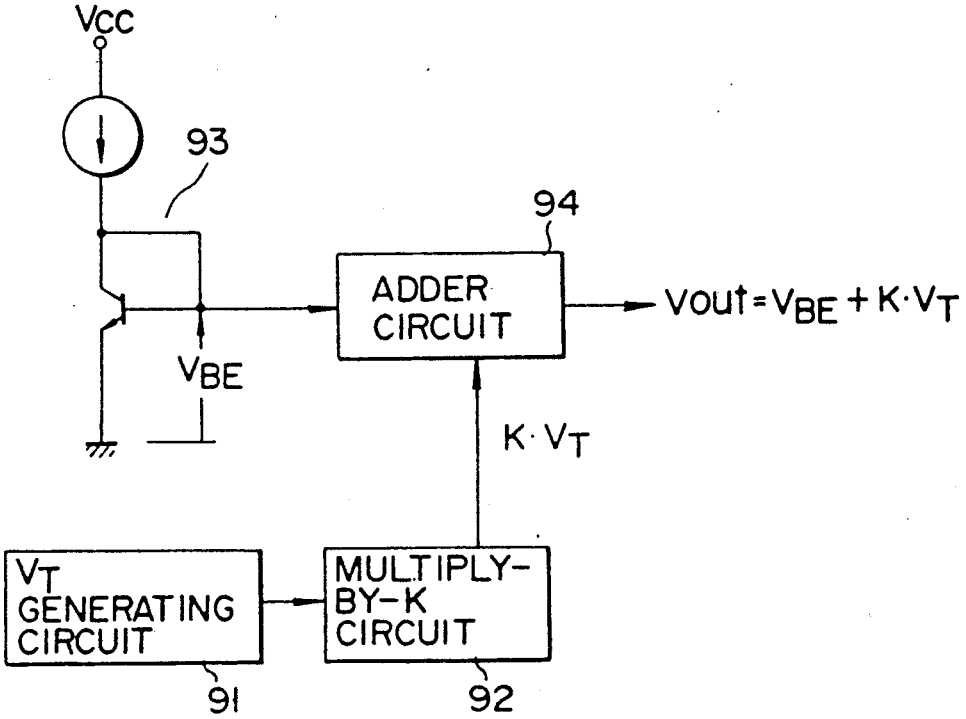
FIG. 5 (PRIOR ART)
FIG. 5 illustrates the principle of operation of the prior art voltage generating circuit shown in FIG. 2.

In general Kn=n K so that Vcsn=n Vcs. By the use of the voltage generating circuit of FIG. 12, it becomes possible to produce an output potential which is an integral multiple (n times) of the output potential Vcs of the voltage generating circuit of FIG. 9 relatively easily. As is the case with the voltage generating circuit of FIG. 9, the voltage generating circuit of FIG. 10 may be provided with (n−1) NPN transistors each having its base and collector connected together between the emitter of third NPN transistor Q3 and $V_{EE}$ potential in order to produce an output potential which is an integral multiple (n times) of the output potential $V_{BB}$ of the voltage generating circuit of FIG. 2.

Also, the voltage generating circuit of the present invention may, of course, be used for generating reference potentials in various circuits as well as for generating reference potentials of ECL circuits.

Figure 6A:
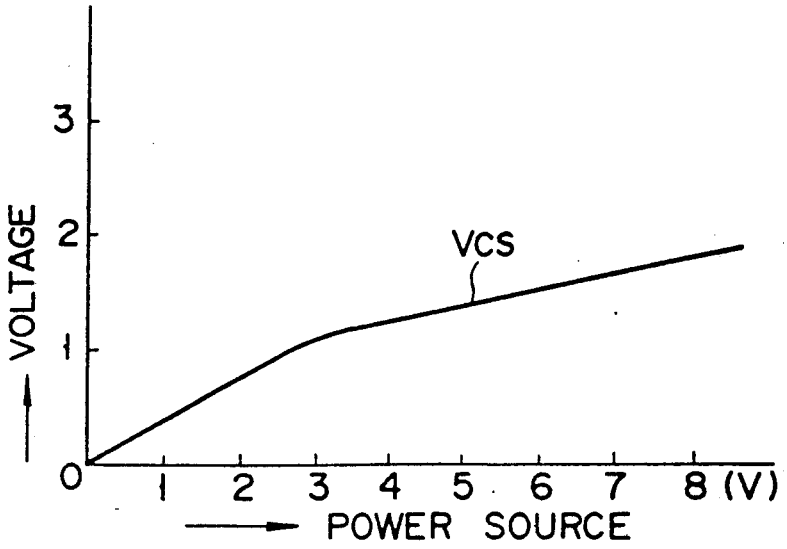
FIG. 6A (PRIOR ART)
FIG. 6A is a graph illustrating the Vcc-supply-voltage dependence of constant currents in the prior art voltage generating circuit shown in FIG. 2.
Figure 6B:
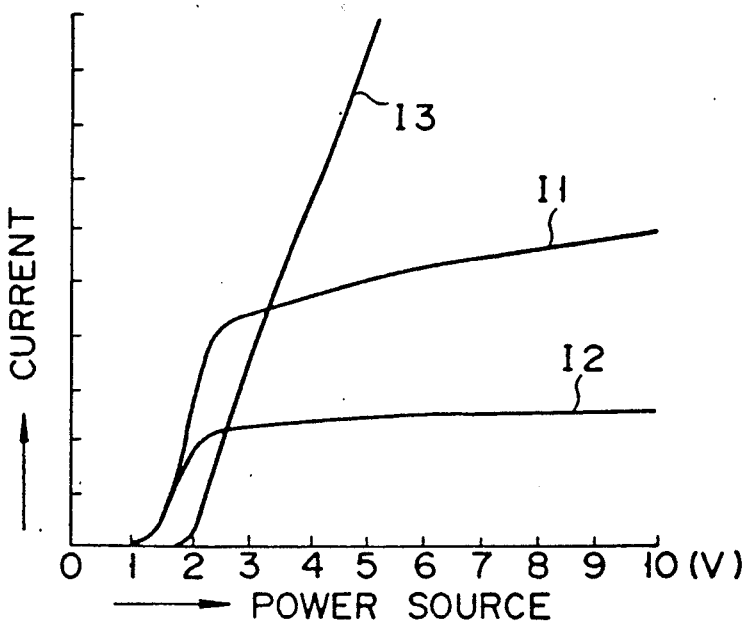
FIG. 6B (PRIOR ART)
FIG. 6B is a graph illustrating the Vcc-supply-voltage dependence of the output potential of the prior art voltage generating circuit shown in FIG. 2.
Figure 7:
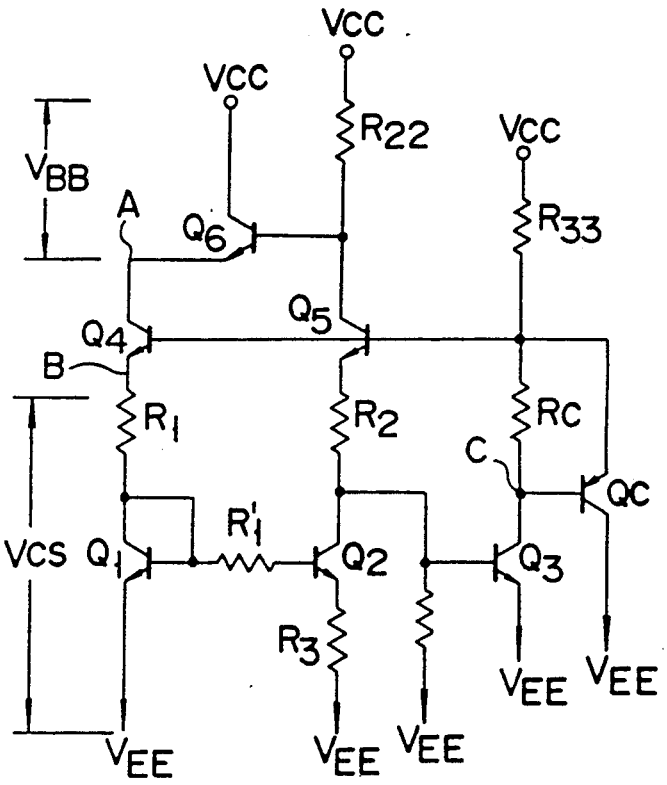
FIG. 7 (PRIOR ART)
FIG. 7 is a circuit diagram of another prior art voltage generating circuit.

According to the voltage generating circuit of the present invention, as described above, it is possible to obtain a constant output voltage free from its dependency upon a power supply voltage. That is, a constant output potential with no temperature dependence that satisfies the temperature compensation condition over a wide range of supply voltage can be provided. The voltage generating circuit can be implemented only by using existing NPN transistors, MOS transistors and resistors in a Bi-CMOS integrated circuit without increasing manufacturing steps. That is, problems with the conventional voltage generating circuit are that, as can be seen from FIGS. 6A and 6B, an output voltage varies with a variation in the supply voltage because currents flowing through bipolar transistors associated with temperature compensation have the supply voltage dependence and the temperature compensation condition is satisfied only over a narrow range of the supply voltage. The use of PNP transistors in part as shown in FIG. 7 to solve the problems would increase the manufacturing steps and cost and reduce the yield. The voltage generating circuit of the present invention can be implemented only by the use of existing NPN transistors, MOS transistors and resistors in a Bi-CMOS integrated circuit without increasing manufacturing steps. According to the voltage generating circuit of the present invention, as is evident from FIGS. 11A and 11B, because currents flowing through bipolar transistors associated with temperature compensation have no supply voltage dependence, an output voltage will not vary with the supply voltage. Also, if the temperature compensation condition is satisfied at a given supply voltage, then a constant output potential can be provided which has no temperature dependence over a wide range of the supply voltage. Also, the voltage generating circuit of the present invention may be used for generating reference potentials in various circuits as well as reference potentials in ECL circuits. The circuit of FIG. 12 can produce a given reference potential and thus has many applications.

Further, according to the present invention it is possible to readily obtain an output voltage having an arbitrary temperature characteristic.

What is claimed is:

1. A voltage generating circuit comprising:

a first current source for generating a first current;

first voltage generating means for generating a first voltage age having a first temperature dependency;

second voltage generating means for generating a second voltage having a second temperature dependency different than the first temperature dependency, said second voltage generating means including a bi-polar transistor having a collector-to-emitter path coupled between said first current source and a first potential;

voltage adder means coupled to said first and second voltage generating means for adding the first and second voltages to generate a third voltage;

voltage replicating means coupled to said voltage adder means for replicating the third voltage as a fourth voltage of a level corresponding to the third voltage;

a second current source for generating a constant second current through a resistive element biased by the fourth voltage; and current replicating means coupled to said first and second current sources for replicating the second current as the first current.

2. The voltage generating circuit according to claim 1 wherein said first voltage generating means comprises:

a second bipolar transistor having a base, an emitter, and a collector, the base and the collector of said second bipolar transistor being coupled together and the emitter of said second bipolar transistor being coupled to the first potential;

a third bipolar transistor having a base, an emitter, and a collector, the base of said third bipolar transistor being coupled to the base of said second bipolar transistor and the emitter of said third bipolar transistor being coupled to the first potential;

a first resistor coupled to the collector of said second bipolar transistor; and a second resistor coupled to the collector of said third bipolar transistor.

3. The voltage generating circuit according to claim 2, wherein the base of said first bipolar transistor is coupled to a point between the collector of said third bipolar transistor and said second resistor, the emitter of said first bipolar transistor is coupled to the first potential, and the collector of said first bipolar transistor is coupled to the first current source.

4. The voltage generating circuit according to claim 2, wherein said voltage adder means comprises said second resistor and the base-to-emitter path of said first bipolar transistor.

5. The voltage generating circuit according to claim 2, wherein said voltage replicating means comprises fourth and fifth bipolar transistors each having a base, an emitter, and a collector, the bases of said fourth and firth bipolar transistors being coupled together and to said current replicating means, the emitter of said fourth bipolar transistor being connected to said current source and said current replicating means, the emitter of said fifth bipolar transistor being coupled to said second resistor.

6. The voltage generating circuit according to claim 1, wherein said current replicating means comprises first and second MOS transistors each having a gate and a drain, the gate and drain of said first MOS transistor being coupled to each other, the gate of said second MOS transistor being connected to a point between the gate and drain of said first MOS transistor, and the drain of said second MOS transistor being connected to said first current source.

7. The voltage generating circuit according to claim 6 wherein said first current source is formed by a current path arranged between the drain of said second MOS transistor and the collector of said first bipolar transistor.

8. The voltage generating circuit according to claim 1, wherein said first voltage generating means comprises a plurality of bipolar transistors.

9. A voltage generating circuit comprising:

a first current source for generating a first current;

a first voltage generating circuit for generating a first voltage having a first temperature dependency;

a second voltage generating circuit for generating a second voltage having a second temperature dependency different than the first temperature dependency;

a voltage adder circuit coupled to said first and second voltage generating circuits for adding the first and second voltage to generate a third voltage having no temperature dependency;

a voltage replicating circuit coupled to said voltage adder circuit for replicating the third voltage as a fourth voltage of a level corresponding to the third voltage;

a resistive element biased by the fourth voltage;

a second current source for generating a constant second current through said resistive element; and a current replicating circuit coupled to said first and second current sources for replicating the second current as the first current.

10. A voltage generating circuit for an emitter-coupled logic (ECL) circuit, comprising:

a first current source for generating a first current;

a first voltage generating circuit for generating a first voltage having a first temperature dependency;

a second voltage generating circuit for generating a second voltage having a second temperature dependency different than the first temperature dependency;

a voltage adder circuit coupled to said first and second voltage generating circuits for adding the first and second voltage to generate third voltage having no temperature dependency;

a voltage replicating circuit coupled to said voltage adder circuit for replicating the third voltage as a fourth voltage of a level corresponding to the third voltage;

a resistive element biased by the fourth voltage;

a second current source for generating a constant second current through said resistive element; and a current replicating circuit comprising a MOSFET current mirror coupled to said first and second current sources for replicating the second current as the first current.

* * * * *